US006550483B1

(12) United States Patent
Dittrich

(10) Patent No.: US 6,550,483 B1
(45) **Date of Patent: *Apr. 22, 2003**

(54) SMOKING ARTICLE WITH WATER-DISINTEGRATABLE PAPER FILTRATION MATERIAL HAVING WATER-SUSCEPTIBLE ADHESIVES

(75) Inventor: David John Dittrich, Southampton (GB)

(73) Assignee: British-American Tobacco (Investments) Limited, Southampton (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,179

(22) PCT Filed: Jan. 8, 1997

(86) PCT No.: PCT/GB97/00054

§ 371 (c)(1),
(2), (4) Date: Jun. 30, 1998

(87) PCT Pub. No.: WO97/24934

PCT Pub. Date: Jul. 17, 1997

(30) Foreign Application Priority Data

Jan. 12, 1996 (GB) ..... 9600608

(51) Int. Cl.[7] ..... A24F 7/04; A24B 15/00

(52) U.S. Cl. ..... 131/202; 131/360; 131/361; 131/331

(58) Field of Search ..... 131/202, 365, 131/331, 332, 340, 345, 342, 360, 361, 362, 341; 162/139

(56) References Cited

U.S. PATENT DOCUMENTS 5,690,126 A * 11/1997 Matsumura et al. ..... 131/343
5,709,227 A * 1/1998 Arzonico et al. ..... 131/341
5,758,669 A * 6/1998 Taniguchi et al. ..... 131/340

FOREIGN PATENT DOCUMENTS

| | | | | |
|---|---|---|---|---|
| EP | 0597478 | | 5/1994 | |
| EP | 0612482 | | 8/1994 | |
| EP | 0 641 525 | * | 3/1995 | ..... 131/341 |
| EP | 0777977 | | 6/1997 | |
| JP | 947271 | | 2/1997 | |
| JP | 947272 | | 2/1997 | |
| WO | WO 9416581 | | 8/1994 | |

OTHER PUBLICATIONS

"To Avoid Consumer Resistance By Using Filtrona's New Puracel Filters, Cigarette Manufacturers May Reduce 'Tar' Yields Without Boosting Pressure Drop", TR Tobacco Reporter, Sep. 1989, p. 34.
"Paper" & "Paperless", The Oxford Encyclopedic English Dictionary, 1991, p. 1052.
"Paper", Longman Dictionary of the English Language, 1984, p. 1062.
"Cellulose Acetates" and "Paper", The Wordsworth Dictionary of Science & Technology, 1988, p. 144 & 646.
"Paper", The New Encyclopaedia Britaqnnica, vol. 9, 1986, p. 126.
"Paper", The Webster's Third New International Dictionary, 1966.

* cited by examiner

*Primary Examiner*—Steven P. Griffin
*Assistant Examiner*—Dionne A. Walls
(74) *Attorney, Agent, or Firm*—Pitney, Hardin, Kipp & Szuch LLP

(57) ABSTRACT

A cigarette is provided with a filter comprising a filter element of water-disintegratable paper. The paper is water swellable and/or the filter element comprises a water swellable agent. Tipping which interattaches the filter to the tobacco rod of the cigarette is anchored by means of water susceptible adhesive. Thus when the cigarette comes into contact with sufficient water, the filter element swells and the tipping opens away from the filter. This facilitates disintegration of the water-disintegratable paper.

3 Claims, No Drawings

SMOKING ARTICLE WITH WATER-DISINTEGRATABLE PAPER FILTRATION MATERIAL HAVING WATER-SUSCEPTIBLE ADHESIVES

This application is a national stage application of PCT/GB97/00054 filed Jan. 8, 1997 which was published in English.

The subject invention relates to smoking articles comprising a rod of smoking material and a smoke filter.

It has been proposed in respect of cigarettes to provide filters therefor which exhibit enhanced moisture-induced disintegration characteristics. One such filter is disclosed in EP 612 482.

In WO 94/16581 there is proposed a filter cigarette the filter plug of the filter of which cigarette embodies a substance which expands upon contact with water. It is envisaged in WO 94/16581 that such expansion of the substance causes expansion of the filter plug and that this expansion of the filter plug will result in rupture of the respective materials of both the plugwrap and the tipping, the stated object of such rupture being the exposure to the environment of a greater area of the filter material of the filter plug thus to enhance the biodegradation of the filter material.

The subject invention provides a smoking article comprising a rod of smoking material, a filter and tipping wrapper means interattaching said rod and said filter, said filter comprising a filter element, which filter element comprises water-disintegratable paper filtration material, said material being water swellable and/or said element comprising a water swellable agent, and adhesive anchoring said tipping wrapper means to said filter being water susceptible adhesive. Thus upon said filter being contacted by a sufficiency of water, swelling of said material and/or said agent causes circumferential enlargement of said filter element, and said adhesive ceases to anchor said tipping wrapper means to said filter. By preference, the anchorage of the tipping wrapper means to said rod is also by way of water susceptible adhesive.

The said adhesive anchors said tipping wrapper means of said filter by way of forming a longitudinal lap seam of the tipping wrapper means and/or by serving to provide circumferential anchorage of the tipping wrapper means. Such circumferential anchorage is suitably provided only at a narrow zone at, or close to, the mouth end of the tipping wrapper means and a narrow zone at the other end thereof, i.e. the end overlying the rod of smoking material. Use of a water susceptible adhesive for circumferential anchorage (should such be present) as well as for forming the lap seam, enables the complete disattachment of the tipping wrapper means from the smoking article upon the smoking article coming into contact with water.

In a similar fashion, if the filter comprises a plugwrap it is advantageous for circumferential anchorage (if present) of the plugwrap, as well as a lap seam anchorage of the plugwrap, to be provided by water susceptible adhesive, so that complete disattachment of the plugwrap from the filter element can occur upon contact of the smoking article with water.

When a smoking article, a cigarette for example, in accordance with the subject invention comes into contact with water by being immersed to a degree therein or by contact by precipitative droplets of water, the filter element swells. In that the water also causes the moisture susceptible adhesive to cease to maintain anchorage of the tipping wrapper means, and similarly the water causes the moisture susceptible adhesive of the plugwrap, if a plugwrap is present (as it usually is), to cease to maintain the anchorage of the plugwrap, the swelling of the filter element is accompanied by opening at the seam of the tipping wrapper means and, if present, of the plugwrap.

Once the tipping wrapper has opened and, if a plugwrap is present, once the plugwrap too has opened, the paper filtration material of the filter element can disintegrate in the sense that fibres constituting the material become separated. Thus, for example, when a cigarette according to the subject invention is immersed in a body of water, the fibres of the paper filtration material can become separated, and dispersed in the body of water, with only a minimal degree of agitation, in a period of only 5–10 minutes from the inception of the immersion. This mode of disintegration of the paper filtration material is mechanical disintegration, as opposed to biodegradation, although, as will be realised by those skilled in the art, the fibres of the material can, subsequent to the speedy separation thereof, be subject to inherently slower biodegradation processes. Such processes will, of course, be aided by the separation of the fibres.

By preference, the water swellable agent (if present) serves, prior to the filter being contacted with water such as to cause swelling of said agent, to maintain the integrity of the paper of said paper filtration material, but does not so serve once water has caused swelling of the agent.

Advantageously, the fibres of the paper are fibrillated to a comparatively low extent.

Suitably, the water susceptible adhesive is a starch based adhesive.

The material of the tipping wrapper, which material is preferably paper, is advantageously of an enhanced disintegrative character.

If present, plugwrap means enwrapping the filter element is suitably of water disintegratable material and is preferably a paper. Advantageously, the fibres of a paper plugwrap are bound together by a binding agent for the purpose of maintaining the integrity of the plugwrap paper, and the agent is preferably a water susceptible binding agent.

Substances suitable for use as a water swellable agent of the subject invention can comprise, for example, carboxymethyl cellulose, water dispersible starch or chemically modified starch, or a so-called super absorbent polymer such as AQUALIC CA (Trade Name) from Ultrasorb Chemikalien GmbH and AQUASORB (Trade Name) from Aqualon BV (Netherlands).

As an alternative to a water swellable agent being coated over the surface of a paper web(s) providing the paper filtration material of the filter element, the agent can take the form of a discrete body, or of discrete bodies, dispose at the filter element.

The water-disintegratable paper filtration material is suitably PURACELL (Trade Name) from Papeteries de Mauduit, which material is cellulose fibre free of cellulose ester and which material is of a water swellable nature.

Suitably, the filter element takes the form of a filter plug, advantageously a filter plug of conventional cylindrical conformation.

What is claimed is:

1. A smoking article comprising a rod of smoking material, a filter and wrapping paper means extending about said filter, adhesive anchoring said wrapper means being water susceptible adhesive and said filter comprising water-disintegratable paper filtration material, said paper filtration material being comprised of a paper web of water swellable cellulose fibres free of cellulose ester, and being such that upon immersion of said smoking article in a body of water, said fibres swell causing circumferential enlargement of said filtration material and said adhesive ceases to completely anchor said wrapper means to said filter causing opening of said wrapper means and thereby permitting said filtration material to disintegrate with a minimal degree of agitation into separated fibres in a period of 5–10 minutes from the inception of the immersion.

2. A smoking article according to claim 1, wherein said wrapper means comprises tipping wrapper means anchored to said rod and to said filter by water susceptible adhesive.

3. A smoking article according to claim 1 or 2, wherein said wrapper means comprises a plugwrap of said filter, which plugwrap is anchored to the filter by water susceptible adhesive.

* * * * *